US005224608A

United States Patent [19]

Paquette

[11] Patent Number: 5,224,608

[45] Date of Patent: Jul. 6, 1993

[54] FILING DEVICE HANGER BAR

[75] Inventor: Edmund T. Paquette, Shrewsbury, Mass.

[73] Assignee: Wright Line Inc., Worcester, Mass.

[21] Appl. No.: 855,962

[22] Filed: Mar. 23, 1992

[51] Int. Cl.[5] ..... A47F 7/16

[52] U.S. Cl. ..... 211/46; 211/206; 312/184

[58] Field of Search ..... 211/206, 46, 45, 126; 312/184, 233; 52/738, 630, 588

[56] References Cited

U.S. PATENT DOCUMENTS

| | | | |
|---|---|---|---|
| 2,952,341 | 9/1960 | Weiler | 52/630 X |
| 3,128,851 | 4/1964 | Deridder et al. | 52/630 X |
| 3,165,104 | 1/1965 | Zippel | 312/184 |
| 3,208,457 | 9/1965 | Zippel | 323/184 X |
| 3,358,848 | 12/1967 | Johnsson | 211/206 X |
| 3,980,360 | 9/1976 | Wright et al. | 312/184 |
| 4,033,652 | 7/1977 | O'Brien | 312/233 X |
| 4,056,296 | 11/1977 | Hedstrom et al. | 312/184 |
| 4,155,607 | 5/1979 | Sitler et al. | 211/46 X |
| 4,171,854 | 10/1979 | Hedstrom et al. | 312/184 |
| 4,327,952 | 5/1982 | Cournoyer et al. | 312/184 |
| 4,473,158 | 9/1984 | Barbar | 211/46 |
| 4,679,955 | 7/1987 | Marsh | 312/184 X |

OTHER PUBLICATIONS

Applicant's Exhibit No. 1, drawing showing a center hook filing device hanger bar, admitted to be prior art.

Applicant's Exhibit No 2, drawing showing two different hanger bars, both of which are admitted to be prior art.

Applicant's Exhibit No 3, copy of catalog Form No. 1-90-4 of Wright Line, A Unit of Applied Power Inc., 160 Gold Star.

Boulevard, Worcester, Massachusetts 01606, admitted to be prior art.

*Primary Examiner*—Blair M. Johnson

*Attorney, Agent, or Firm*—Quarles & Brady

[57] ABSTRACT

A filing device hanger bar supports a center hook cartridge binder from its center hook for storage or from either end of the binder in an inverted inclined position for accessing the inner pages of the document bound by the cartridge binder. The hanger bar has a bead flange for supporting a center hook cartridge binder from its center hook for storage and a retention lip above the bead flange for engaging an end of the binder to support the binder in an inverted inclined position for accessing the document bound by the cartridge binder. A support flange above the retention lip supports end hook filing devices for storage, and another retention lip above the support flange may also be used for engaging an end of the binder to support the binder in an inverted inclined position for accessing the document bound by the cartridge binder.

5 Claims, 2 Drawing Sheets

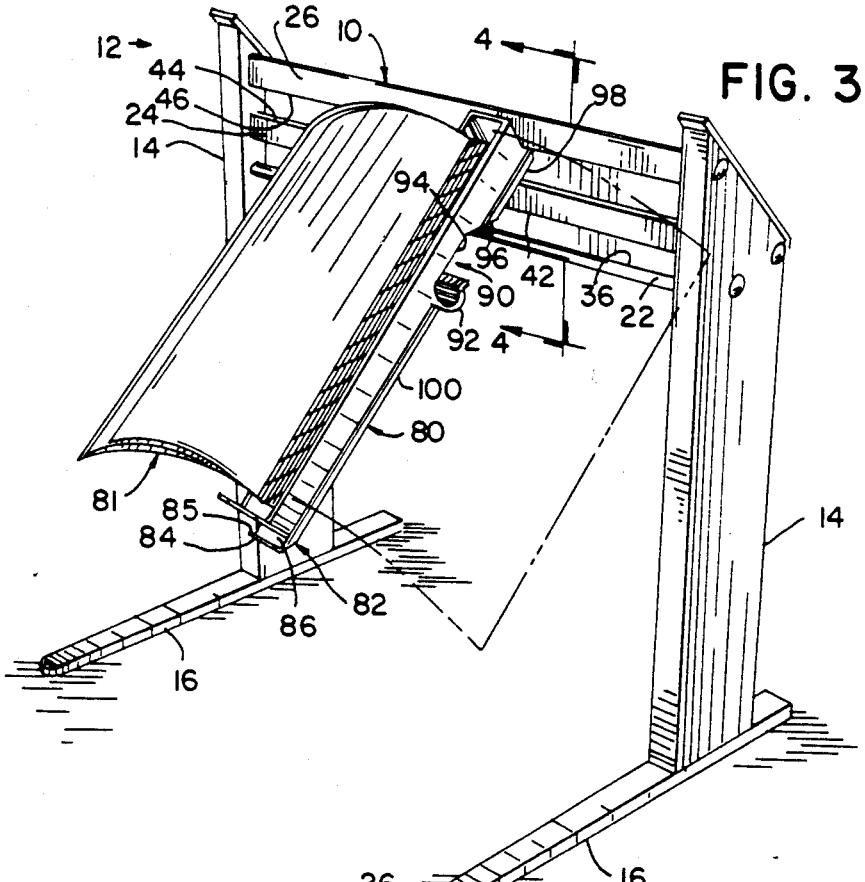
FIG. 3
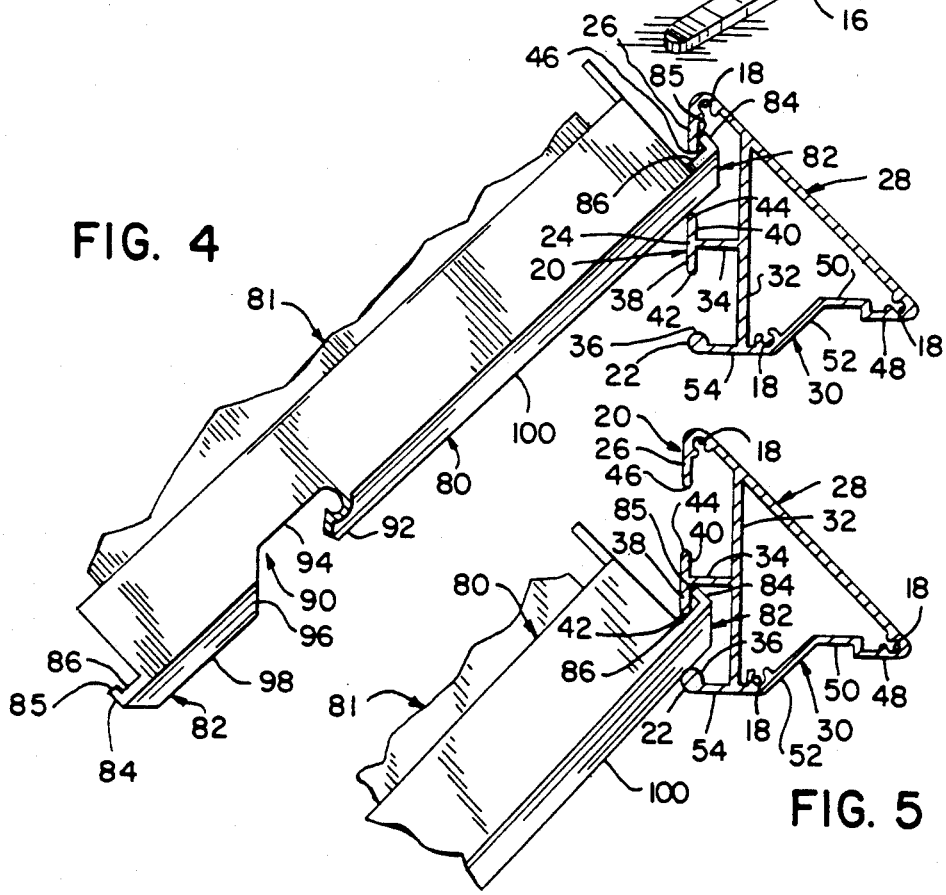
FIG. 4
FIG. 5

FILING DEVICE HANGER BAR

FIELD OF THE INVENTION

This invention relates to hanger bars for storing filing devices, and in particular to a hanger bar for cartridge binder filing devices.

BACKGROUND OF THE INVENTION

Filing devices for storage of files or other items are well known and of many different types. Such filing devices include bins, binders, pockets, frames and generally any type of container or binder for storing paper files, magnetic media or other items.

One type of filing device has a hook for supporting it from a hanger bar. Such devices include "end hook devices", which have a hook at one end and "center hook devices" which have a hook between the ends of the device, although not necessarily in the center. An example of an end hook device is the bin shown in FIG. 1 and an example of a center hook device is the cartridge binder shown in FIG. 1.

Previously, end hook devices required one type of hanger bar and center hook devices required a different, separate hanger bar. Existing cartridge binders as shown in FIGS. 1 and 2 have a shoulder at each end so that the binder can alternatively be used in a conventional hanging type filing system, where the file is suspended from each end by rails. In either method of filing the cartridge binder, to access the inner pages of the document bound by the cartridge, the binder had to be removed from the hanger bar or the rails and supported manually or a surface found to lay the document down on so that it could be opened. Although inconvenient, this has long been a conventional way of accessing cartridge bound documents.

SUMMARY OF THE INVENTION

The invention provides a filing device hanger bar for storing filing devices and particularly also capable of supporting a cartridge bound document to allow access to the document. The bar has a substantially vertical face with a substantially horizontal flange for supporting a filing device in storage, and a retention lip running generally parallel to the flange. The retention lip presents a downwardly facing edge opposite from the flange, and the bar is supported substantially horizontally. The retention lip is spaced above the flange so that a filing device can be cantilevered from one of its ends positioned between the retention lip and the first flange, with the end of the device bearing against the retention lip and against the first flange so as to support the device in an inverted inclined position. In this position, the hanger bar supports a document bound by the device, preferably a center hook cartridge binder, so that a user can open the document to have access to its inner pages.

In an especially useful form, the end of the cartridge binder from which the cartridge binder can be cantilevered has a lip-like extension for engaging behind the retention lip and a recessed surface for engaging the edge of the retention lip. Preferably, the extension engages the retention lip substantially in line contact and the recessed surface may engage the edge of the retention lip substantially in line contact to hold the binder stable against excessive twisting, with the document spine held generally parallel to the retention lip edge. Thus, with the document spine held substantially stable and parallel to the lip, the document will be held stable and the document will tend to stay opened to the page turned to by the user.

In another useful aspect, the flange is a bead flange presenting an upwardly facing horizontally extending surface which is convex fore and aft. Preferably, the hanger bar has a cam surface behind the bead flange for camming on a center hook device to engage the center hook device into a storage position and to rotate the center hook device out of the storage position for removal. A support flange may also be provided above and generally parallel to the bead flange and presenting an upwardly facing edge which may be used for supporting end hook filing devices. Another retention lip may be provided above the support flange so that a cartridge binder may also be supported in the access position from one of its ends between the support flange and the upper retention lip.

These and other features and advantages of the invention will be apparent from the drawings and the detailed description.

BRIEF DESCRIPTION OF THE DRAWINGS

FIG. 3 is a perspective view of the hanging unit of FIG. 1 shown supporting the cartridge binder in an inverted inclined position;

FIG. 4 is a cross-sectional view taken along the plane of the line 4—4 of FIG. 3; and FIG. 5 is a view similar to FIG. 4 but showing the cartridge binder supported in an alternative inverted inclined position.

DETAILED DESCRIPTION OF THE PREFERRED EMBODIMENTS

Figure 1:
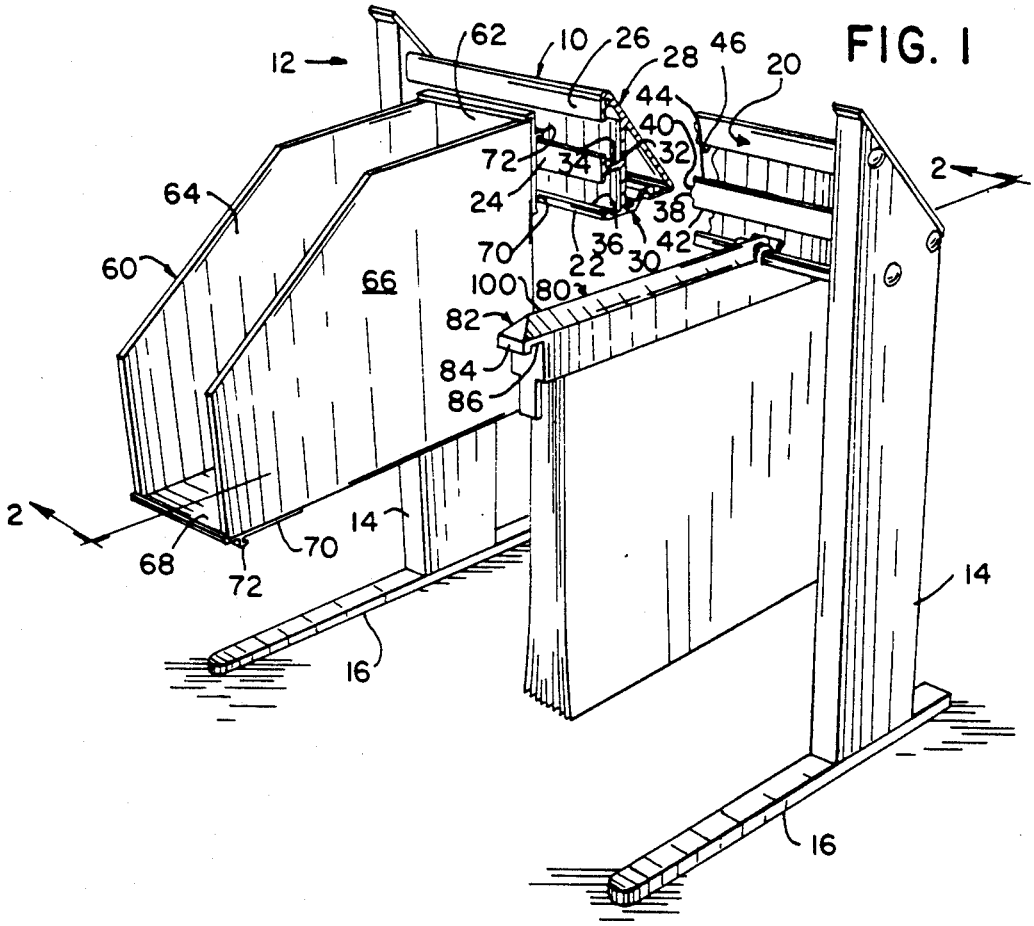
FIG. 1 is a perspective view of a file storage unit incorporating a hanger bar of the invention shown with a portion of the hanger bar broken away and with the hanger bar supporting an end hook bin and a center hook cartridge binder.

Referring to FIG. 1, a hanger bar 10 Of the present invention is included as part of a filing unit 12, which also includes supports 14 and feet 16. The feet 16 are secured to the bottom of the supports 14 with suitable fasteners (not shown) and the hanger bar 10 is secured to each of the supports 14 with three screws which are engaged in bores 18 (FIG. 2) at the corresponding ends of the hanger bar 10.

The hanger bar 10 is preferably an aluminum extrusion of a generally triangular profile as shown in the drawings. The filing unit 12 supports the hanger bar 10 so that it is substantially horizontal and has a substantially vertical face 20. Defining the vertical face 20 is a bead flange 22 at the bottom of the vertical face 20, an intermediate flange 24 and a retention lip 26 spaced above the intermediate flange at the top of the vertical face 20.

The hanger bar 10 also has a generally rearwardly facing downwardly slanted side 28 and a generally downwardly facing bottom side 30. In the preferred embodiment, the bead flange 22 is an extension of the bottom face 30, the retention lip 26 is co-terminus with the rear face 28 and a bridging web 32 spans the rear face 28 and bottom face 30 to make the hanger bar 10 strong and rigid, and also support the intermediate flange 24 at the vertical face 20 by a horizontally extending web 34.

The bead flange 22 presents a generally horizontally extending surface 36 which is convex fore and aft. The intermediate flange 24 has a lower portion 38 (below horizontal web 34) which acts as a second retention lip and an upper portion 40 which acts as a support flange. The second retention lip 38 presents a downwardly facing edge 42 which is spaced above and generally parallel to surface 36 and the support flange 40 presents an upwardly facing edge 44 which is spaced below and generally parallel to downwardly facing edge 46 of retention lip 26.

The bottom side 30 has a foot portion 48 at its rear and a generally horizontal web 50 spaced above the lower surface of foot portion 48, a cam portion 52 presenting a surface which is downwardly inclined in the forward direction and a horizontal web 54 which connects the cam portion 52 and the bead flange 22.

Figure 2:
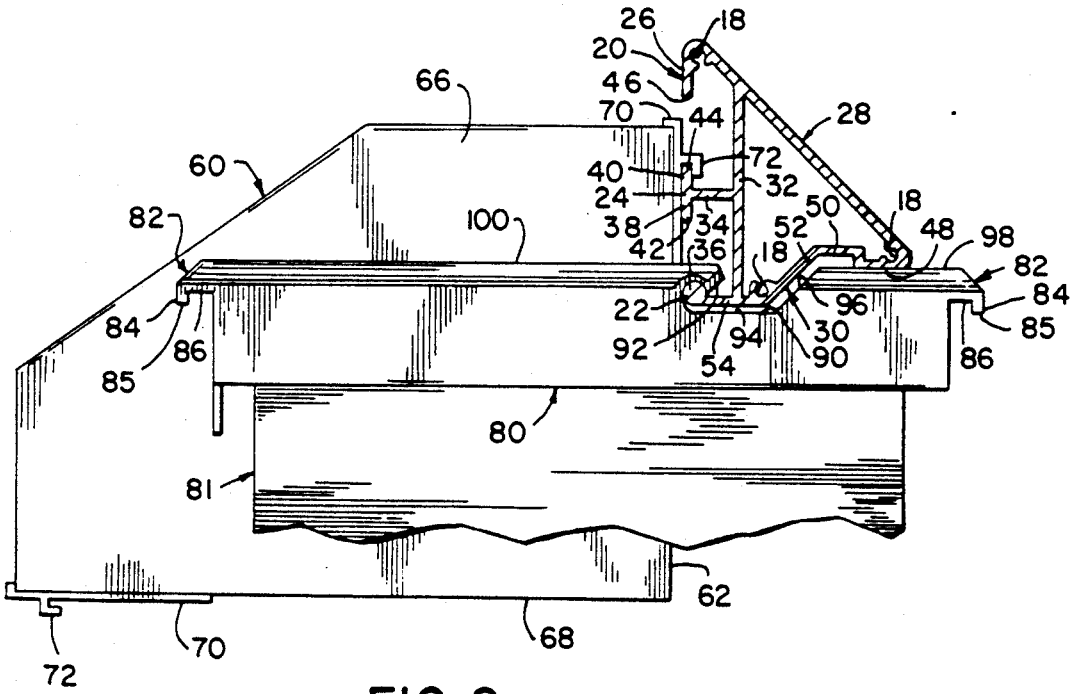
FIG. 2 is a cross-sectional view taken along the plane of the line 2—2 of FIG. 1.

Two illustrative hook filing devices 60 and 80 are also shown in FIGS. 1 and 2. It should be understood that these are only two types of such devices, and that any type of hook type device which could be suitably supported from the hanger bar 10 could be used in practicing aspects of the invention.

One of the devices shown in FIGS. 1 and 2 is a bin 60 having four sides 62, 64, 66 and 68. The bin 60 may be used for storing books, catalogs, pamphlets, magnetic media, drawings or any item which would fit inside of it. At each end of the bin 60, against sides 62 and 68, a backing 70 having a hook 72 is rigidly secured by welding, a suitable adhesive or any other suitable means. It should be noted that the hook 72 could also be integrally formed with the sides of the bin 60.

The hook 72 can be hooked over edge 44 of support flange 40 in the manner shown in the FIGS. 1 and 2 to support the bin 60 from the hanger bar 10. Therefore, the bin 60 may be supported from either end thereof. Since the weight of the bin 60 is supported out in front of the vertical face 20, supporting the bin 60 in this manner creates a moment which is reacted against by the backing 70 bearing against the bead flange 22, as best shown in FIG. 1.

FIGS. 1 and 2 also show a center hook device 80 which is a cartridge binder. Cartridge binders such as cartridge binder 80 are well known and commercially available under the designation "Documate TM" from Wright Line Inc., a unit of Applied Power Inc., Worcester, Mass. Cartridge binders such as cartridge binder 80 are also described in detail in U.S. Pat. Nos. 4,056,296 and 4,171,854, the disclosures of which are hereby incorporated by reference.

The cartridge binder 80 is preferably molded plastic and used for binding a multi-leaf loose-leaf document 80 to store the same in a filing unit. The binder 80 is provided with hook-like extensions or shoulders 82, one at each end, which may be used for storing the binder 80 in a conventional hanging file folder type file drawer where the files are suspended from both ends by rods or rails which run perpendicularly to the direction of the files. Each shoulder 82 has a lip-like extension 84 and a recessed surface 86, so that a suspension rail on each side of a two-rail conventional suspension filing system would be engaged against the recessed surface 86 and between the extension 84 and the body of the binder 80.

The binder 80 also has a recess 90 intermediate its ends. The recess 90 defines a hook 92 having a downwardly facing concave surface for engaging the convex surface 36. The recess 90 also defines a generally horizontal surface 94 opposite from web 54, an inclined surface 96 opposite from cam portion 52, and generally horizontal surface 98 opposite from horizontal web 50 and foot portion 48 and which bears against foot portion 48. Binder 80 and the document 81 which it binds are supported by hook 92. Since hook 92 is not symmetrically located in the center of the binder 80, but more weight of the document 81 and binder 80 is supported in front of bead flange 22 than behind it, the binder 80 and document 81 are subjected to a moment, which is resisted by the foot 48 bearing against surface 98. This moment tends to turn the binder 80 and document 81 counterclockwise about the bead flange 22 as viewed in FIG. 2. Therefore, once the hook 92 is partially engaged with the surface 36, the moment will cause the cam portion 52 to cam on the inclined surface 96 to pull the binder rearwardly relative to the bar 10 to fully engage the hook 92 with the surface 36. In addition, for removal of the binder 80 from the hanger bar 10, pulling the binder 80 straight forward will result in hook 92 lifting off surface 36 and cam portion 52 camming on surface 96 so as to rotate the front of binder 80 upwardly so that hook 92 can be completely disengaged from the bead flange 22.

Referring now to FIGS. 3 and 4, it will be seen that the binder 80 may be alternatively supported from the hanger bar 10 in an inverted (document 81 facing up) inclined position so as to allow a user access to the document 81. In this alternative support position, the binder 80 is cantilevered from either of its ends by shoulders 82. As best shown in FIG. 4, one of the shoulders 82 is inserted so that it is facing generally upwardly into the space between the edges 44 and 46. When the binder 80 is released, edge 44 of support flange 40 bears against spine 100 of binder 80 and extension 84 of shoulder 82 engages behind retention lip 26 with surface 86 bearing against edge 46.

The extension 84 catching behind lip 22 and surface 86 bearing against edge 46 helps support the document 81 so it can be opened and helps prevent the binder 80 from slipping out from between the support flange 40 and the retention lip 22. Preferably, extension 84 of shoulder 82 engages retention lip 26 and surface 86 engages edge 46 in substantial and generally horizontal line contact so as to support binder 80 against excessive twisting and hold the transverse direction of the spine of the document 81 generally parallel to retention lip 26. Thus, when the document 81 is opened to a particular page, it tends to stay opened to that page. The line contact is said to be substantial because the free end 85 of the extension 84 and the surface 86 may have a very shallow V-shape as viewed from the end of the binder 80, to allow draft, for example of a few degrees, for the binder 80 to be removed from a mold when it is cast in a plastic molding operation. Although contact would not be continuous along the entire width of the extension 84 because of the draft, the draft angle is so slight that the amount of rocking of the binder 80 allowed by the engagement of the extension 84 behind the retention lip 26 and the surface 86 with the edge 46 is negligible and tolerable. Thereby, document 81 can be opened as shown in phantom in FIG. 3 to access its inner pages while being supported by the hanger bar 10 and held against excessive twisting.

FIG. 5 shows the binder 80 supported in a manner similar to FIGS. 3 and 4, but with one of the shoulders 82 inserted into the space between the bead flange 22 and the retention lip 38. In this access position, the bead flange 22 bears against spine 100 and the shoulder 82 is engaged with lip 38 with the end 85 of extension 84 wedged into the inside corner between lip 38 and web 34 so as to support the document 81 so that it can be opened for access to its inner pages in much the same manner as shown in FIG. 4. In this position, surface 86 may not exert any appreciable force on edge 42 and a small space may exist between the surface 86 and the edge 42.

Many modifications and variations of the invention will be apparent to those of ordinarily skill in the art but which will still embody the spirit and scope of the invention. For example, a hanger bar of the invention may be supported by any suitable means such as it could be made a part of a desk or workstation, a library cart, an office panel or partition or a mobile cart. It could also be supported between two walls. Therefore, the invention should not be limited to the preferred embodiment described, which should be defined by the claims which follow.

We claim:

1. A filing device hanger bar, comprising:

a center hook cartridge binder having a center hook;

a bar having a substantially vertical forwardly facing face, said face having:

a substantially horizontal flange for supporting said center hook cartridge binder from said center hook; and a retention lip running generally parallel to said flange and extending downwardly, said retention lip presenting at its lower extent a downwardly facing edge opposite from said flange; and means supporting said bar substantially horizontally;

wherein said retention lip is spaced above said flange and said retention lip and said flange define a space therebetween and behind said downwardly facing edge of said retention lip, said space being open to said face of said bar and of a size to receive an end of said cartridge binder so that said binder can be cantilevered from said end thereof positioned between said retention lip and said flange with said end bearing against said retention lip and against said flange so as to support said binder in an inverted inclined position.

2. A filing device hanger bar as in claim 1 wherein an end of said center hook cartridge binder from which said center hook cartridge binder can be cantilevered from between said flange and said retention lip has a lip-like extension for engaging behind said retention lip and a recessed surface for engaging said edge of said retention lip.

3. A filing device hanger bar as in claim 2, wherein said extension engages said retention lip substantially in line contact.

4. A filing device hanger bar as in claim 2, wherein said recessed surface engages said edge of said retention lip substantially in line contact.

5. A filing device hanger bar as in claim 2, wherein said extension and said recessed surface engage said retention lip substantially in line contact.

* * * * *